United States Patent [19]

Butzen

[11] Patent Number: 5,031,367

[45] Date of Patent: Jul. 16, 1991

[54] ROOF EDGE FASCIA SYSTEM

[76] Inventor: William J. Butzen, N57 W15167 Mesa Dr., Menomonee Falls, Wis. 53051

[21] Appl. No.: 517,437

[22] Filed: May 1, 1990

Related U.S. Application Data

[63] Continuation of Ser. No. 349,327, May 8, 1989, abandoned.

[51] Int. Cl.[5] ..... E04D 1/36

[52] U.S. Cl. ..... 52/60; 52/96; 52/300

[58] Field of Search ..... 52/58, 60, 94, 96, 300

[56] References Cited

U.S. PATENT DOCUMENTS

| | | | |
|---|---|---|---|
| 3,624,973 | 12/1971 | Attaway | 52/94 X |
| 3,668,811 | 6/1972 | Pollard | 52/60 X |
| 3,766,694 | 10/1973 | Minialoff et al. | 52/58 X |
| 4,404,777 | 9/1983 | Lolley et al. | 52/60 |
| 4,419,850 | 12/1983 | Butzen . | |
| 4,780,999 | 11/1988 | Webb et al. | 52/60 X |

*Primary Examiner*—David A. Scherbel
*Assistant Examiner*—Lan Mai
*Attorney, Agent, or Firm*—Joseph S. Heino

[57] ABSTRACT

A roof edge fascia system has a base member and a fascia member to secure the edges of a roof-top waterproof membrane and to secure the edges of paving blocks or insulation sheets covering such membrane at the roof edge.

11 Claims, 1 Drawing Sheet

ROOF EDGE FASCIA SYSTEM

This application is a continuation of application Ser. No. 07/349,327, filed May 8, 1989, abandoned.

FIELD OF THE INVENTION

This invention relates to roof edging mechanisms used to secure the edges of roof-top waterproof membranes and more particularly to a roof edge fascia system which secures paving blocks or insulation sheets covering such membranes.

BACKGROUND OF THE INVENTION

The use of waterproof membranes for covering a roof such as a flat roof and the use of mechanisms for securing the edges of such waterproof membranes at the roof edges is well known. In the construction of such mechanisms, or roof edge fascia systems as they are commonly referred to, a dam means is secured to the edge of a roof. The dam means often includes a horizontal portion adapted to be secured to the roof, an upwardly inclined portion or cant extending from the horizontal portion and having an upper edge, and a vertical portion extending downwardly from the upper edge of the cant. A waterproof membrane is laid across the surface of the roof such that an edge of the membrane is laid up against the cant portion of the dam means, over the upper edge and down against the outside surface of the vertical dam portion. A snap-on cap is also included which overlays and clampingly engages the dam means and the interposed membrane. Such membranes are then covered with a suitable layer of ballast such as gravel. The weight of the layer of ballast on the membrane is intended to hold the membrane down against the roof surface. The dam means serves to retain the gravel ballast and control water drainage from the roof. An example of such a system is described and illustrated in the Butzen U.S. Pat. No. 4,419,850.

Although such systems are satisfactory in performance, the utilization of such a dam means and snap-on cap does not readily lend itself to the use of cast roof paver blocks as ballast or other sheetlike insulation to overlay the membrane. Such paver blocks generally comprise cast square concrete blocks, approximately 1½ to 2 inches thick and 2 feet on edge, and are placed on the membrane in edge-to-edge relation. Although the insulation sheets are of similar thickness, approximately 2 to 3 inches thick, they are substantially longer and wider than the dimensions of the paver blocks, may be comprised of a variety of materials and are interlockably engagable by ridges and grooves located in their sides and ends. The above-described system, when utilizing paver blocks or insulation sheets, does nothing to prevent winds of sufficient velocity at the roof top or at the edge of the roof from shifting the paver blocks or insulation sheets or from totally lifting them upwardly and away from the membrane. Such movement by the paver blocks can quite obviously damage the membrane or, in the case of either paver blocks or insulation sheets, result in damage to the blocks or sheets themselves.

SUMMARY OF THE INVENTION

It is therefore a principal object of this invention to provide a new, useful and uncomplicated roof edge fascia system which is capable of securing a roof-top waterproof membrane at the edge of the roof while concomitantly securing roof paver blocks or insulation sheets of varying thicknesses covering the membrane. It is another object of this invention to provide such a roof edge fascia system which accomplishes all of this while requiring only a minimal number of elements and being easily assembled in the field. It is yet another object of this invention to provide such a roof edge fascia system which is capable of compensating for thermal expansion and contraction of the system elements and which remains well aligned and in place at all times and aesthetically appealing from all points outside of the building.

The present invention has obtained these objects by providing for a base member or dam means adapted to be secured to the edge of the roof and by providing for a snap-on cap which overlays and clampingly engages the base member or dam means, the interposed membrane and the roof paver blocks or insulation sheets overlying the membrane. The dam means comprises a horizontal foot portion, an upwardly extending vertical portion and a downwardly extending vertical portion. The foot portion of the dam means is adapted to be fastened to the horizontal surface of the roof edge. The upwardly extending vertical portion of the dam means is adapted to provide support for a waterproof membrane. The downwardly extending vertical portion of the dam means includes a lower edge. The snap-on cap includes a spring means for covering at least a portion of the dam means, a first clamping means for securing the membrane against the dam means and a second clamping means for securing the roof paver blocks or insulation sheets against the membrane. The spring means includes a vertical portion adapted to overlay the upwardly and downwardly extending vertical portions of the dam means and includes a lower bent-over portion adapted to engage the lower edge of the downwardly extending vertical portion of the dam means. After the bent-over portion of the snap-on cap engages the dam means, the membrane and the interposed paver block or insulation sheet are firmly held in place. The foregoing and other features of the present invention will be further apparent from the description that follows.

DETAILED DESCRIPTION

Figure 1:
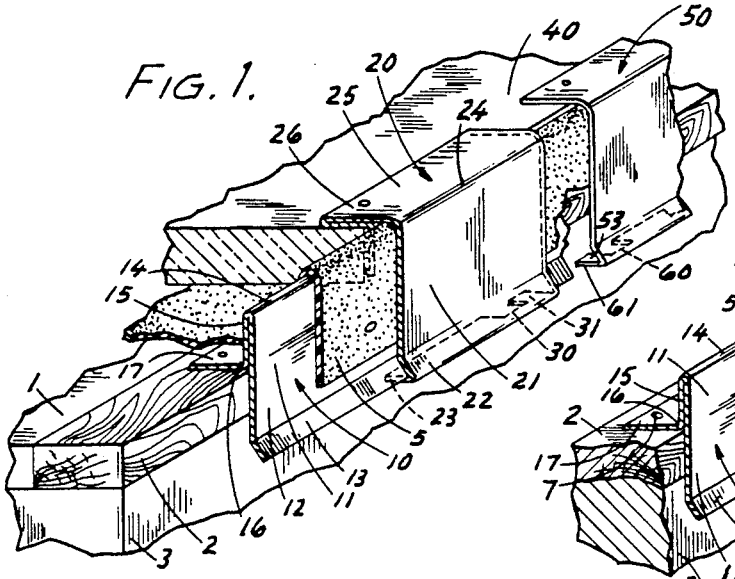
FIG. 1 is a perspective view of the fascia system embodying the invention and with portions broken away.
Figure 2:
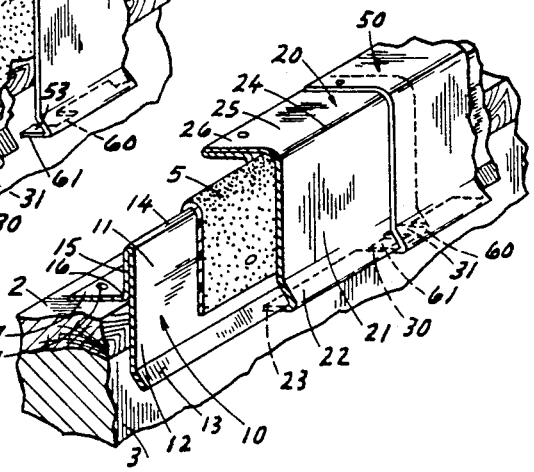
FIG. 2 is a view similar to FIG. 1 but with the snap-on caps in an overlapping secured position.
Figure 4:
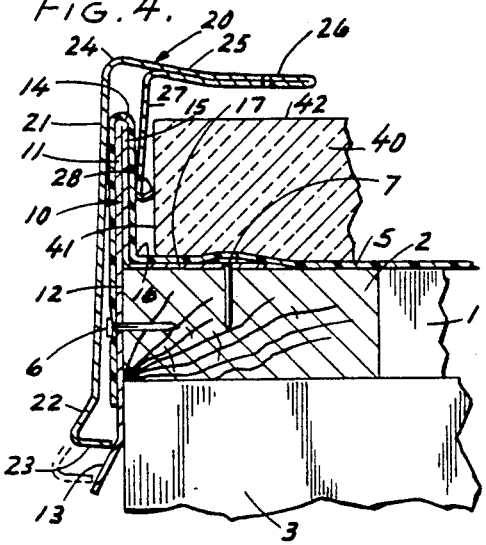
FIG. 4 is a cross-section view of the fascia system shown in FIGS. 1–3, but with the snap-on cap in a raised position.
Figure 5:
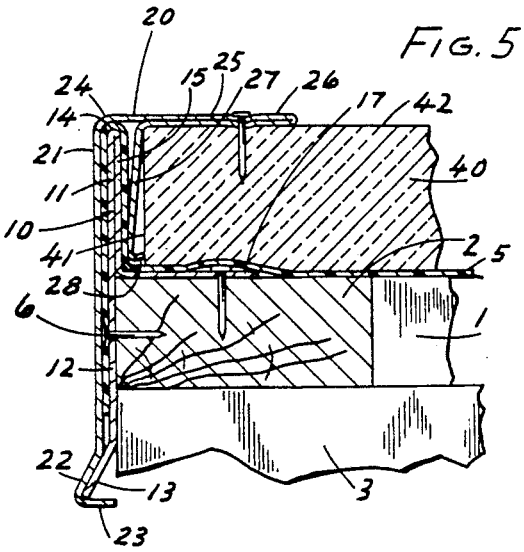
FIG. 5 is a view similar to FIG. 4 but with the snap-on cap in a secured position.

Reference is now made more particularly to the drawings and particularly to FIGS. 1 and 2 which show a roof edge fascia system constructed in accordance with the present invention. As shown, a dam means or base member generally identified 10 is supported by and secured to a wood nailer 2 which is located at the top of a wall 3 and at the edge of the flat generally horizontal upper surface of a roof 1. The base member 10 is comprised of sheet metal material and includes an upwardly extending outer vertical portion 11, said outer vertical portion 11 having an upper edge 14, and a downwardly extending outer vertical portion 12, said downwardly extending outer vertical portion 12 having an outwardly extending lower edge 13. The base member 10 further includes an inner vertical portion 15 extending downwardly from the upper edge 14 of the outer vertical portion 11, said inner vertical portion 15 having a lower edge 16, and a horizontal portion 17 extending inwardly from the lower edge 16 of the inner vertical portion 15, said horizontal portion 17 and the downwardly extending outer vertical portion 12 of the base member 10 adapted to be positioned adjacent the upper and outer surfaces, respectively, of the wood nailer 2. The base member 10 is secured to the wood nailer by means of a fastener 7. See FIG. 4. After the base member 10 has been secured in place, the roof 1 is covered with a waterproof membrane 5. The membrane 5 is adapted to overlay the horizontal base member portion 17 and run upwardly against the inner vertical portion 15, over the upper edge 14 of the outer vertical portion 11 and then downwardly against the outer vertical portion 11 of the base member 10. The membrane 5 is secured by a fastener 6. The membrane is covered by a paver block or insulation sheet 40.

Figure 3:
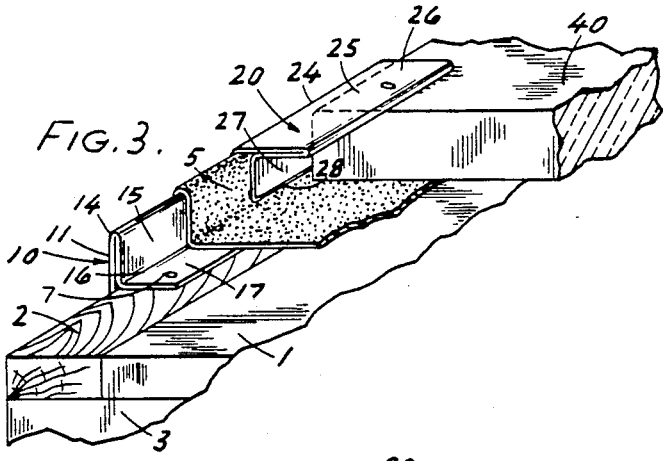
FIG. 3 is a perspective view similar to but from the side opposite that shown in FIGS. 1 and 2.

Means for covering the base member 10, for securing the edge of the membrane 5 in place and for covering and securing the paver block or insulation sheet 40 is provided by a snap-on cap generally identified 20. The snap-on cap 20 is comprised of sheet metal material and has a fascia or outer vertical portion 21. The fascia portion 21 of the snap-on cap 20 includes a lower end bent so as to include a downwardly and outwardly extending portion 22 and an inwardly extending lip 23 thereby defining a channel for receiving the downwardly extending lower edge 13 of the base member 10. See FIG. 4. The snap-on cap fascia portion 21 includes an upper edge 24. Extending inwardly from the fascia portion upper edge 24 is a second clamping means, said clamping means comprising a sloped portion 25 and a generally horizontal lower portion 26. While the second clamping means is resilient and thus capable of accommodating a variety of block or sheet 40 thicknesses, the angle of the bend at the fascia portion upper edge 24 can be increased or decreased to accommodate paver blocks or insulation sheets of substantially lesser or greater thickness, respectively, than that of the block or sheet 40 shown. Extending inwardly and downwardly from the second clamping means lower portion 26 is a first clamping means, said first clamping means having a clamping member 27 and a lower lip member 28. See FIG. 3.

As shown in FIGS. 1 and 2, means for interlocking adjacent snap-on caps 20, 50 is provided. The first snap-on cap 20 is provided with a notch 30 and interlocking member 31 located at one end of the inwardly extending lip 23. The second snap-on cap 50 is provided with a notch 60 and interlocking member 61 located at the correspondingly opposite end of its inwardly extending lip 53. While not shown, it is to be understood that the first cap 20 is provided at its opposite end with the elements provided for at the end of the second cap 50 and that the second cap 50 is provided at its other end with the elements provided for the end of the first cap 20.

During installation of the roof edge fascia system of the present invention, the base member 10 overlays and is fastened to the wood nailer 2 by means of the fastener 7 extending though the horizontal portion 17 of the base member 10. With the base member 10 in place, the waterproof membrane 5 is laid over the roof top 1 and up and over the base member 10 as above described. At this point of installation the edge of the membrane 5 is secured by means of a fastener 6. See FIG. 4. The roof paver block or insulation sheet 40 can then be laid over the membrane 5 providing for clearance between the forward edge 41 of the paver block or insulation sheet 40 and the inner vertical base member portion 15 to permit insertion of the snap-on cap first clamping member 27 therebetween. During installation of the snap-on cap 20, as it is forced downwardly over the base member 10, the inwardly extending lip 23 of the snap-on cap fascia portion 21 will slide downwardly and outwardly along the external surface of the vertical portions 11, 12 of the base member 10 with the membrane 5 interposed therebetween. At the same time, the lip member 28 of the first clamping member 27 of the snap-on cap 20 will slide downwardly along the inner vertical portion 15 of the base member 10 with the waterproof membrane 5 likewise interposed therebetween. When the snap-on cap 20 is almost fully in place, the lip 23 of the snap-on cap fascia portion 21 will then slide downwardly and outwardly along the outwardly extending lower edge 13 of the base member 10. At the same time, the horizontal portion 26 of the second clamping means of the snap-on cap 20 will begin to resiliently engage the upper surface 42 of the paver block or insulation sheet 40. The lip 23 will then snap under the lower edge portion 13 of the base member 10, thereby completing engagement of the snap-on cap 20 with the base member 10 and securing the edge of the membrane 5 and covering and securing the paver block or insulation sheet 40. The second clamping means of the snap-on cap 20 may be provided with a plurality of holes 29 through which fasteners 8 may be placed to secure the clamping means horizontal portion 26 to the upper surface 42 of the paver block or insulation sheet 40 if desired.

With the first snap-on cap 20 in place, the second snap-on cap 50 is positioned in a generally overlapping relationship to the first cap 20. See FIGS. 1 and 2. The second cap 50 is then urged downward in the same manner as the first cap 20 was as above described until the inwardly extending lip 53 engages the lower edge portion 13 of the base member 10. In that position, the notch 30 and interlocking member 31 of the first cap 20 engage the interlocking member 61 and notch 60 of the second cap 50, respectively. This interlock concept allows for thermal movement of the caps 20, 50 while preventing cap separation.

From the foregoing detailed description of the illustrative embodiment of the invention set forth herein, it will be apparent that there has been provided a new, useful and uncomplicated roof edge fascia system which is capable of securing a roof-top waterproof membrane at the edge of a roof while concomitantly securing roof paver blocks or insulation sheets of varying thicknesses covering the membrane and which requires a minimal number of elements, is easily assembled in the field, remains well aligned and which accomplishes all of this while creating an aesthetically appealing fascia system from all points outside of the building to which it is applied.

The principles of this invention having been fully explained in connection with the foregoing, I hereby claim as my invention:

1. A roof edging mechanism for securing the edge of a waterproof membrane overlying a roof and for securing the edge of a ballasting or an insulating layer overlying said waterproof membrane at the roof edge, the edge of the roof defining a generally vertical outer surface, which comprising:

means for securing the edge of a waterproof membrane at the edge of a roof, said membrane securing means comprising a longitudinally extending base member adapted to be secured to the edge of a roof, said base member including a generally vertical portion having a lower edge and an upper edge, said upper edge adapted to support said membrane at and above said roof edge and said vertical portion having a rearward surface a portion of which is adapted to be secured against the outer vertical surface of the roof edge, and said membrane securing means further comprising a longitudinally extending fascia member adapted to cover said base member and to clampingly engage said base member with the membrane interposed therebetween, said fascia member having a generally vertical portion adapted to overlie said vertical base member portion and having a lower edge, said lower edge adapted to engage the lower edge of said vertical base member portions and an upper edge, and means for securing the edge of a ballasting or insulating overlayer at the edge of the roof, said overlayer securing means comprising a longitudinally extending and resilient overlayer clamping member projecting rearwardly from the upper edge of said fascia member vertical portion, said overlayer clamping member adapted to overlie a portion of said overlayer and to resiliently secure said overlayer between said overlayer clamping member and said membrane when said fascia member clampingly engages said base member.

2. The roof edging mechanism of claim 1 wherein said overlayer clamping member comprises a resilient projection extending from the upper edge of said fascia member vertical portion, said projection having a bottom surface, said bottom surface adapted to engage said overlayer, and further having a member extending downwardly from said projection bottom surface and adapted to clampingly engage the membrane at the rearward surface of said vertical base member portion.

3. The roof edging mechanism of claim 1 wherein said resilient overlayer clamping member projects slightly downwardly relative to the horizontal to resiliently engage and clamp roof overlayers of various thicknesses.

4. The roof edging mechanism of claim 2 wherein the resilient projection of said overlayer clamping member includes a downwardly sloped upper portion and a generally horizontal lower portion.

5. The roof edging mechanism of claim 4 wherein said vertical fascia portion and the sloped upper portion of the resilient projection of said overlayer clamping member define an angle of bend which is variable to accommodate overlayers of varying thicknesses.

6. A roof edging mechanism for securing the edge of a waterproof membrane overlaying a roof at the outer edge of the roof, the roof edge defining a generally vertical outer surface, and for securing the edge of a ballasting or an insulating layer overlaying the membrane, the roof edging mechanism comprising a base member having a vertical portion adapted to be secured to the vertical surface of the outer edge of the roof, said vertical base member portion including a downwardly extending member and an upwardly extending member, said downwardly extending member having a lower edge and said upwardly extending member having an outer and an inner vertical surface adapted to support the edge of a waterproof membrane thereon, and a fascia member for covering a portion of said base member and for engaging said base member, said fascia member including a vertical fascia portion adapted to cover said base member vertical portion and having a lower edge and an upper edge, said lower edge adapted to engage said downwardly extending base member lower edge, means for clampingly engaging an edge of the waterproof membrane between said fascia member and said base member at the inner surface of said upwardly extending vertical base member, and means for clampingly engaging the edge of a ballasting or insulating layer overlying said waterproof membrane between said fascia member and said membrane, said overlayer clamping means comprising a first clamping member extending inwardly from said fascia member vertical portion upper edge, said first clamping member having a bottom surface adapted to engage said overlayer, and said membrane clamping means comprising a second clamping member extending downwardly from the bottom surface of said first clamping member, said second clamping member adapted to clampingly engage the membrane at the inner vertical surface of said upwardly extending base member.

7. The roof edging mechanism of claim 6 wherein said base member comprises a first sheet of resilient metal material and said fascia member comprises a second sheet of resilient metal material.

8. The roof edging mechanism of claim 7 wherein said vertical fascia portion and said first clamping member define an angle of bend which is variable to accommodate overlayers of varying thicknesses.

9. The roof edging mechanism of claim 7 wherein said first clamping member includes a downwardly sloped upper portion and a generally horizontal lower portion.

10. The roof edging mechanism of claim 9 wherein said vertical fascia portion and the downwardly sloped portion of said first clamping member define an angle of bend which is variable to accommodate overlayers of varying thicknesses.

11. The roof edging mechanism of claim 7 wherein said first clamping member extends downwardly at an acute angle relative to the horizontal, said angle being variable such that said first clamping member is capable of resiliently engaging and clamping roof overlayers of various thicknesses.

* * * * *